US012377359B1

(12) United States Patent
Medwed

(10) Patent No.: US 12,377,359 B1
(45) **Date of Patent: *Aug. 5, 2025**

(54) PLUSH STUFFED WITH MOLDED OR SCULPTED FOAM

(71) Applicant: GennComm LLC, Tarzana, CA (US)

(72) Inventor: Jeremy Brian Medwed, Woodland Hills, CA (US)

(73) Assignee: GennComm, LLC, Tarzana, CA (US)

( * ) Notice: Subject to any disclaimer, the term of this patent is extended or adjusted under 35 U.S.C. 154(b) by 161 days.

This patent is subject to a terminal disclaimer.

(21) Appl. No.: 18/127,580

(22) Filed: Mar. 28, 2023

Related U.S. Application Data

(63) Continuation-in-part of application No. 17/406,191, filed on Aug. 19, 2021, now Pat. No. 11,623,156, and a continuation-in-part of application No. 16/823,030, filed on Mar. 18, 2020, now Pat. No. 11,311,814, which is a continuation of application No. 16/564,118, filed on Sep. 9, 2019, now Pat. No. 10,596,475, which is a continuation of application No. 15/985,595, filed on May 21, 2018, now Pat. No. 10,427,061.

(60) Provisional application No. 62/508,800, filed on May 19, 2017.

(51) Int. Cl.
*A63H 3/02* (2006.01)
*A63H 13/16* (2006.01)

(52) U.S. Cl.
CPC ..... *A63H 3/02* (2013.01); *A63H 13/16* (2013.01)

(58) Field of Classification Search
CPC ..... A63H 3/02; A63H 13/16
USPC ..... 446/73, 75, 226, 268, 369, 385
See application file for complete search history.

(56) References Cited

U.S. PATENT DOCUMENTS 2,224,456 A * 12/1940 Janas ..... A63H 9/00 446/318
2,668,394 A * 2/1954 Auzin ..... A63H 3/48 264/300
2,760,302 A * 8/1956 Cheskin ..... A63H 33/00 221/56

(Continued)

FOREIGN PATENT DOCUMENTS

EP 0206500 A1 * 5/1986 ..... A63H 3/02
GB 2110098 A * 6/1983 ..... A63H 3/02

OTHER PUBLICATIONS

NuLine Concepts Product Catalog.
www.temupedic.com/other-products/tempur-plush-teddy-bear/v/804.

*Primary Examiner* — Alexander R Niconovich
(74) *Attorney, Agent, or Firm* — Gugliotta & Gugliotta LPA

(57) ABSTRACT

A plush toy system is provided having a composite insert of a foam inner made with a compressible foam and an augmentation element contained therein. A flexible outer covering surrounds the foam inner and has an inner surface for contacting the foam inner. The inner foam is compressed and constrained by the flexible outer covering such that it does not achieve a natural uncompressed size. The flexible outer covering is formed into a shape, or the inner foam is formed into the shape and the flexible outer covering is shaped to and aligned with the shape of the foam inner and entirely surrounding the foam inner such that the inner foam is not fully expanded and is constrained or compressed by the flexible outer covering.

14 Claims, 15 Drawing Sheets

(c) 2025 GennComm, LLC

(56) References Cited

U.S. PATENT DOCUMENTS 2,952,462 A * 9/1960 Planin ..... A63H 33/00 446/385
3,354,578 A * 11/1967 Ryan ..... B29C 67/205 156/212
4,054,204 A * 10/1977 Keeton ..... B65D 85/07 206/83.5
4,170,086 A * 10/1979 Hills ..... A63H 3/02 428/100
4,233,775 A * 11/1980 Neufeld ..... A63H 3/04 446/370
4,505,687 A * 3/1985 Munro ..... A63H 3/02 446/385
4,629,441 A * 12/1986 Cahill ..... A63H 9/00 112/420
4,881,915 A * 11/1989 Liaw ..... A63H 13/02 446/385
4,884,991 A * 12/1989 Terzian ..... A63H 3/02 446/369
4,936,460 A * 6/1990 Meyer ..... B65D 5/528 206/524.8
4,952,190 A * 8/1990 Tarnoff ..... A63H 3/00 446/385
5,009,626 A * 4/1991 Katz ..... B44C 1/1712 347/3
5,027,457 A * 7/1991 Sweet ..... A47G 9/1045 5/640
5,090,938 A * 2/1992 Reynolds ..... G09B 19/0061 434/137
5,096,760 A * 3/1992 Thary ..... B32B 5/245 5/655.9
5,178,807 A * 1/1993 Thary ..... B32B 5/20 427/245
5,224,894 A * 7/1993 Nelson ..... A63H 33/004 446/310
5,413,332 A * 5/1995 Montgomery ..... A63B 43/002 473/570
5,462,473 A * 10/1995 Sheller ..... A63H 3/36 446/183
5,503,584 A * 4/1996 Tulling ..... A63H 33/20 446/49
5,613,892 A * 3/1997 Barton ..... A63H 3/06 446/224
5,649,875 A * 7/1997 Spector ..... A63B 65/00 473/610
5,813,896 A * 9/1998 Spector ..... B62K 9/00 446/221
5,885,128 A * 3/1999 Blaustein ..... A63H 3/02 446/369
5,895,308 A * 4/1999 Spector ..... A63H 3/02 446/183
5,897,418 A * 4/1999 Spector ..... A63H 3/06 446/268
5,961,363 A * 10/1999 Spector ..... A63H 3/06 446/385
6,126,510 A * 10/2000 Weiss, Jr. ..... A63H 3/02 446/431
6,155,904 A * 12/2000 Spector ..... A63B 69/34 446/311
6,261,146 B1 * 7/2001 Spector ..... A63H 33/00 446/385
6,264,526 B1 * 7/2001 Meeker ..... A63H 3/36 446/385
6,283,817 B1 * 9/2001 Kawaguchi ..... A63H 3/31 446/297
6,575,807 B2 * 6/2003 Spector ..... A63H 33/00 446/385
6,672,932 B1 * 1/2004 Panec ..... A63H 3/20 446/221
7,331,840 B2 * 2/2008 Amico, Jr. ..... A63H 9/00 446/369
7,507,138 B2 * 3/2009 Chernick ..... A63H 3/02 446/268
7,682,216 B2 * 3/2010 Spector ..... A63H 33/38 281/31
7,730,853 B2 * 6/2010 Axelrod ..... B32B 3/263 119/709
7,887,386 B2 * 2/2011 Yu ..... A63H 3/02 446/72
7,887,387 B2 * 2/2011 Colvin ..... A63H 3/005 446/379
10,004,342 B2 * 6/2018 Waters ..... A47D 13/025
10,576,390 B2 * 3/2020 Rosenbaum ..... A63H 3/02
2004/0038618 A1 * 2/2004 Atkins ..... B41M 5/0256 446/268
2006/0054020 A1 * 3/2006 Dhillon ..... A61L 9/22 96/15
2007/0099539 A1 * 5/2007 Fullmer ..... A63H 3/06 446/369
2007/0248940 A1 * 10/2007 Maguire ..... G09B 19/00 446/369
2008/0220688 A1 * 9/2008 Cuisinier ..... A63H 3/005 446/73
2009/0088045 A1 * 4/2009 Kotzer Jacobs ..... D05B 97/00 112/475.08
2010/0237542 A1 * 9/2010 Zhang ..... A63H 9/00 264/342 R
2011/0117809 A1 * 5/2011 Bowar ..... A63H 3/005 446/369
2011/0217900 A1 * 9/2011 Lai ..... A63H 9/00 446/369
2013/0017756 A1 * 1/2013 Lai ..... A01K 15/025 446/369
2013/0288567 A1 * 10/2013 Blue ..... A63H 3/02 446/268
2014/0287649 A1 * 9/2014 Rebella ..... A63H 33/004 446/73
2014/0364034 A1 * 12/2014 Lee ..... A63H 3/003 446/297
2015/0290546 A1 * 10/2015 Alves ..... A63H 3/02 446/369
2025/0058237 A1 * 2/2025 Maldovan ..... A63H 3/02

* cited by examiner (c) 2020 GennComm, LLC (c) 2020 GennComm, LLC (c) 2020 GennComm, LLC (c) 2020 GennComm, LLC (c) 2020 GennComm, LLC FIG.10 A
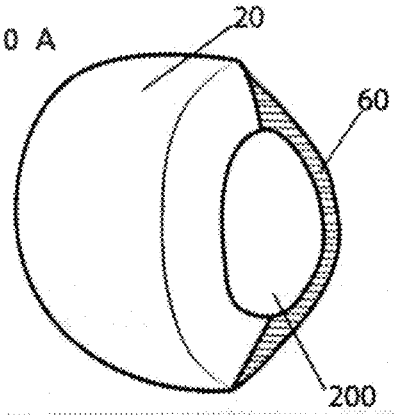
FIG.10 B
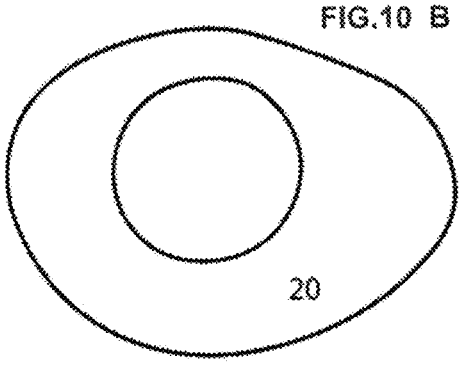
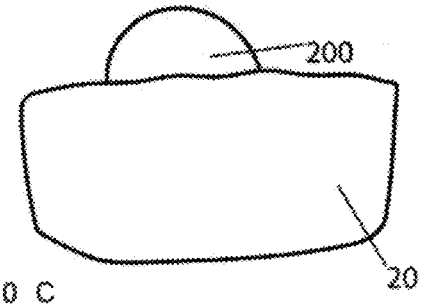
FIG.10 C
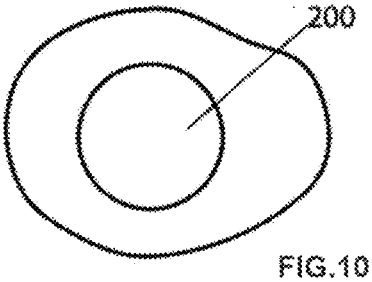
FIG.10 D FIG.11 A
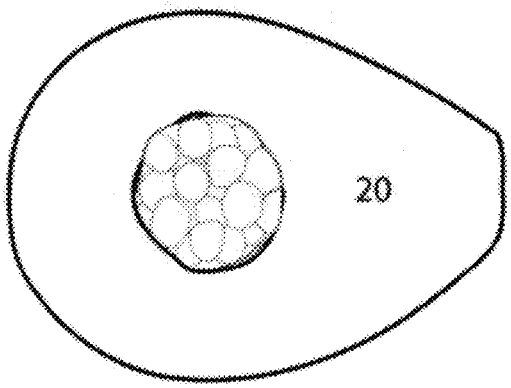
FIG.11 B
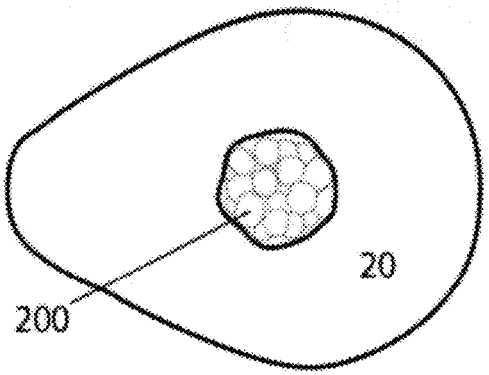
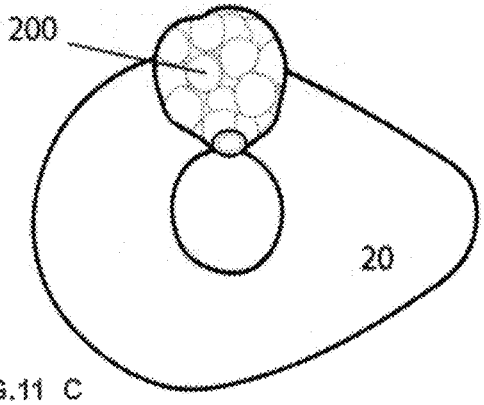
FIG.11 C
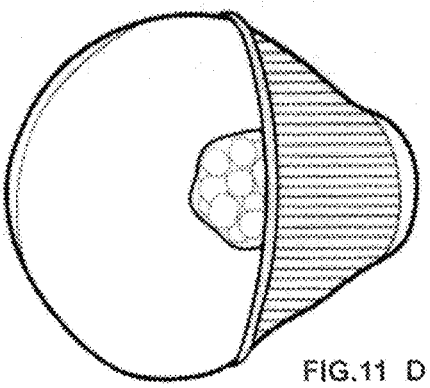
FIG.11 D FIG.12 A
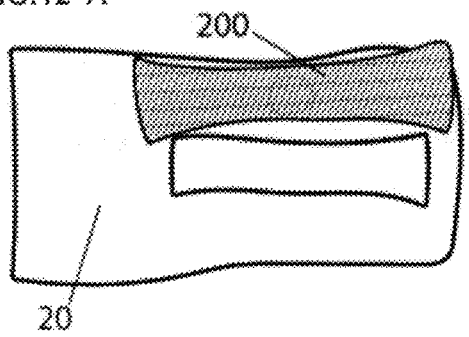
FIG.12 B
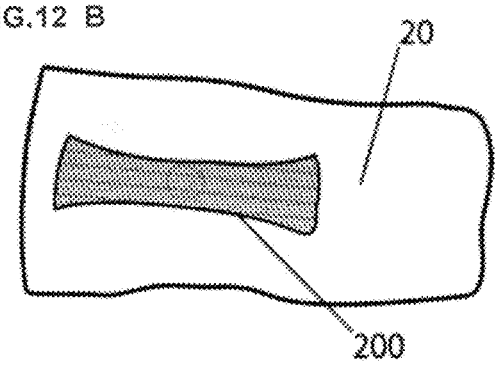
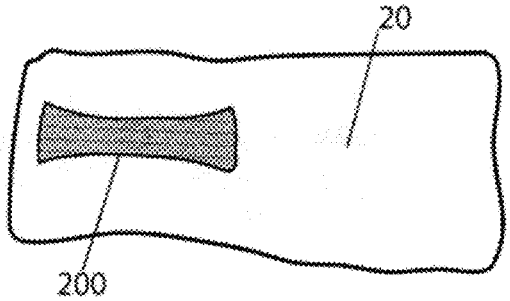
FIG.12 C
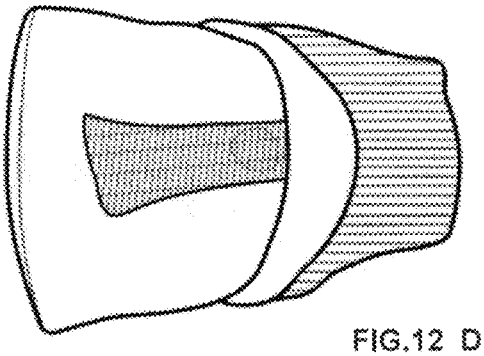
FIG.12 D FIG.13 A
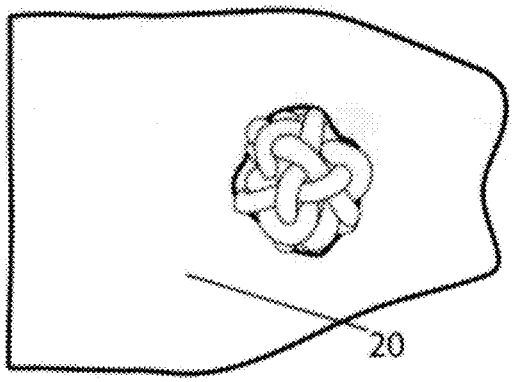
FIG.13 B
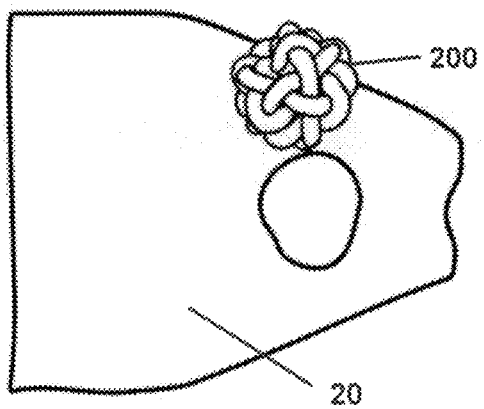
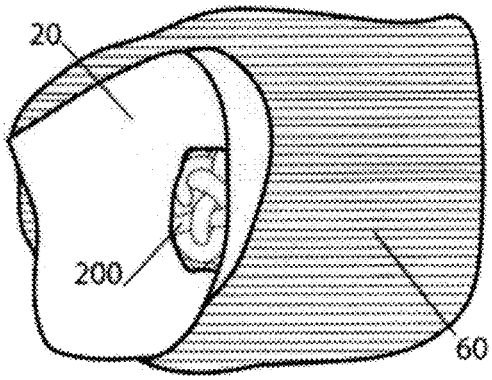
FIG.13 C

PLUSH STUFFED WITH MOLDED OR SCULPTED FOAM

RELATED APPLICATIONS

This application is a continuation in part of U.S. patent application Ser. No. 17/406,191, filed on Aug. 19, 2021 which is a continuation in part of U.S. patent application Ser. No. 16/823,030, filed Mar. 18, 2020, which is a Continuation of U.S. patent application Ser. No. 16/564,118, filed Sep. 9, 2019, now U.S. Pat. No. 10,596,475, which is a Continuation of U.S. patent application Ser. No. 15/985,595, filed Nov. 22, 2018, now U.S. Pat. No. 10,427,061, which claims priority to Application No. 62/508,800, filed May 19, 2017, each entitled "PLUSH STUFFED WITH MOLDED OR SCULPTED FOAM," and which are expressly incorporated herein by reference.

COPYRIGHT NOTICE

Pursuant to 37 C.F.R. 1.71(d)-(e)(1988), a portion of the disclosure of this patent document contains material which is subject to (copyright or mask work) protection. The (copyright or mask work) owner has no objection to the facsimile reproduction by any one of the patent document or the patent disclosure, as it appears in the Patent and Trademark Office patent file or records, but otherwise reserves all (copyright or mask work) rights whatsoever.

BACKGROUND OF THE INVENTION

1. Field of the Invention

This invention relates to plush toys, and more particularly to a compressible viscoelastic or memory-foam based plush toy.

2. Description of the Related Art

Plush toys are well known and have been a favorite style of toy for generations. Traditional plush toys are not easily compressed, however, for the purpose of reducing their shipping and storage size, and/or to conceal their expanded shape, without damaging the plush toy and permanently deforming it. Traditional polyester fiberfill and wool are used in the prior art, but such fill for a plush toy does not enable the plush toy to be compressed without damage and expand into its original shape.

Therefore, there is a need for a system that allows a plush toy to be compressed to less than its normal, expanded size without permanently deforming the plush toy or changing its shape when subsequently expanded to its natural size. Such a needed invention could include a package that is either a different shape than the final shape of the plush toy, promoting surprise and mystery for the end user of such a system, or that resembles the shape of the plush toy but in a miniature form, or that includes a plurality of such plush toys placed into a product displayed quickly (PDQ) box or tray, or in other ways. Such a needed invention would be relatively inexpensive to manufacture, transport, and store. The present invention accomplishes these objectives.

SUMMARY OF THE INVENTION

It is thus objects of the present invention to provide an improved plush toy and a method for making such an improved plush toy.

It is a feature of the present invention to provide such a plush toy that is stuffed with molded or sculpted compressible viscoelastic or memory-foam.

The present device is a plush toy system comprising a foam inner formed into a shape, such as a character shape such as a doll or animal. The plush toy system is provided having a foam inner made with a compressible foam. A flexible outer covering surrounds the foam inner and has an inner surface for contacting the foam inner. The inner foam is compressed and constrained by the flexible outer covering such that it does not achieve a natural uncompressed size. The flexible outer covering is formed into a shape, or the inner foam is formed into the shape and the flexible outer covering is shaped to and aligned with the shape of the foam inner and entirely surrounding the foam inner such that the inner foam is not fully expanded and is constrained or compressed by the flexible outer covering.

A flexible outer covering surrounds the foam inner and is, in preferred embodiments, sized such that the inner foam is compressed and constrained by the flexible outer covering such that the foam does not achieve its natural size. The outer cover has an inner surface for contacting the foam inner, and an outer surface. The foam inner is contained within and compressed by the flexible outer covering combine to form a plush toy.

In various embodiments the foam inner may further incorporate a number of additional features to augment the functionality of the foam. According to one aspect of the present invention, the functional augmentation may include the addition of a liquid (such a soap or a chemical liquid) or additional foam or other materials of a different density, or "play slime" contained within a filled bladder or other similar retainer within the foam inner. According to another aspect of the present invention a tactile toy or other tactile physical device may be retained within the foam inner. According to yet another aspect of the present invention, motorized devices or audible/tactile electronics may be embedded within the foam inner. In any of these aspects the inclusion of a tactile response component is contained within the foam inner, thereby augmenting the foam inner structure as well as modifying the interaction of such an embedded item by itself (i.e., without embedding within the foam).

In various embodiments the foam inner may further incorporate additional functions or features. Embossing the foam itself with a texture (e.g., ridges, bumps, grooves, etc.) may impart a differential feel through the outer cover and to the outside of the plush toy.

Other variations in the foam inner are further anticipated. By way of example, the foam inner may be a mixture of different foams having different properties to give different densities, textures, or create a movement of effect or the like. By way of additional example, the foam inner may further form a composite material of other non-foam materials in order to provide additional weight and feel.

According to additional embodiments, the present system may include a package having at least one open side through which the plush toy traverses when compressed to fill an interior space of the package. The package may be a rectanguloid, a two-piece ovaloid, or the like. Preferably the foam inner is stored in a compressed size less that of its natural, expanded size when unconstrained by the package. According to one aspect of such additional embodiments, when vacuum sealing the product the orientation of the vacuum sealed item will determine the products vacuum sealed size (for example, by folding a bear in half and subsequently placing within a packaging that will be vacuum sealed, thereby almost halving the product size packaged size). Such an orientation when vacuum sealed also can add an effect to the unboxing or unwrapping as the foam self-reinflates with air when the package is opened. In such an embodiment the plush toy will not only self-inflate but also unfolds itself while doing it.

In use, when the plush toy is compressed and contained within the package, and upon opening of the at least one open side the plush toy at least partially expands out of the at least one open side of the package. When removed completely from the package the plush toy expands to the natural size of the plush toy.

The present invention is a plush toy that can be compressed below it normal size, or size and shape such as to allow for expansion its natural size when deployed. The present system may include a package that is either a different shape than the final shape of the plush toy, promoting surprise and mystery for the end user of such a system, or that resembles the shape of the plush toy but in a miniature form, or that includes a plurality of such plush toys placed into a point-of-purchase display box or tray, or in other ways. Any of the various implementations of the present invention are relatively inexpensive to manufacture, transport, and store.

Further and other objects, features, elements and advantages of the present invention will become apparent from the following more detailed description, taken in conjunction with the accompanying drawings, which illustrate, by way of example, the principles of the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 10A through FIG. 10D are photographs of a proof of concept prototype for a foam inner 20 incorporating an additional functional augmentation insert 200 according to a first alternate embodiment;

FIG. 11A through FIG. 11D are photographs of a proof of concept prototype for a foam inner 20 incorporating an additional functional augmentation insert 200 according to a second alternate embodiment;

FIG. 12A through FIG. 12D are photographs of a proof of concept prototype for a foam inner 20 incorporating an additional functional augmentation insert 200 according to a third alternate embodiment;

FIG. 13A through FIG. 13C are photographs of a proof of concept prototype for a foam inner 20 incorporating an additional functional augmentation insert 200 according to a fourth alternate embodiment;

DESCRIPTION OF THE PREFERRED EMBODIMENTS

Figure 1:
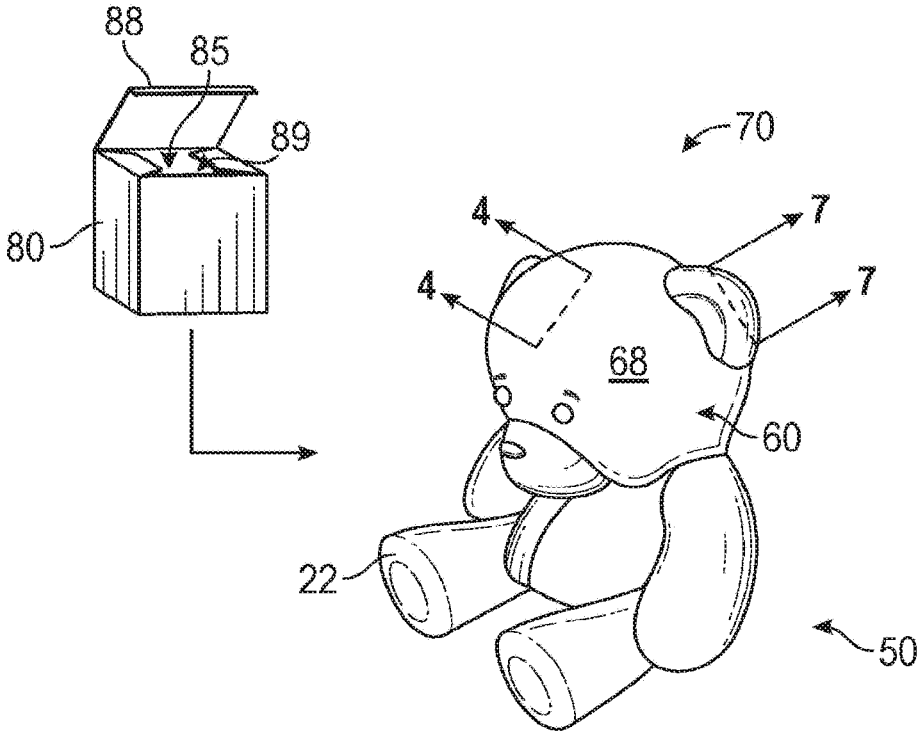
FIG. 1 is an exploded perspective view of the invention, illustrating a plush toy expanded to a natural size after being removed from a package of the invention.
Figure 2:
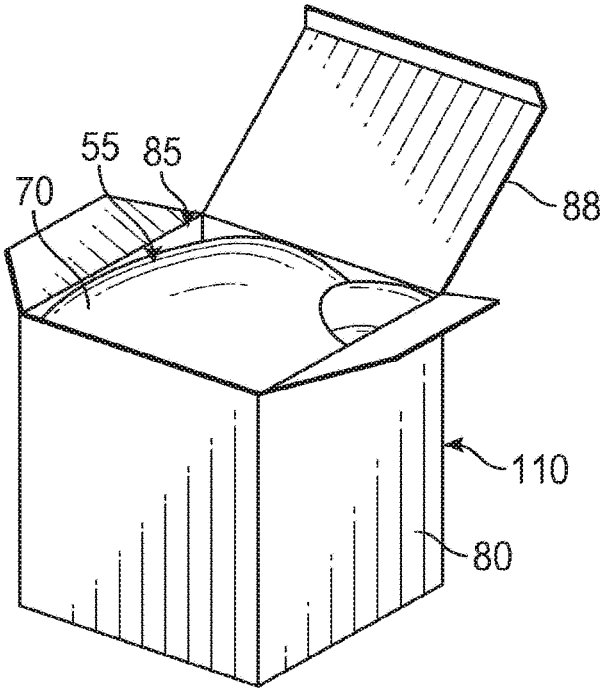
FIG. 2 is a perspective view of the invention, illustrating the plush toy as contained in the package just as the package is opened.
Figure 3:
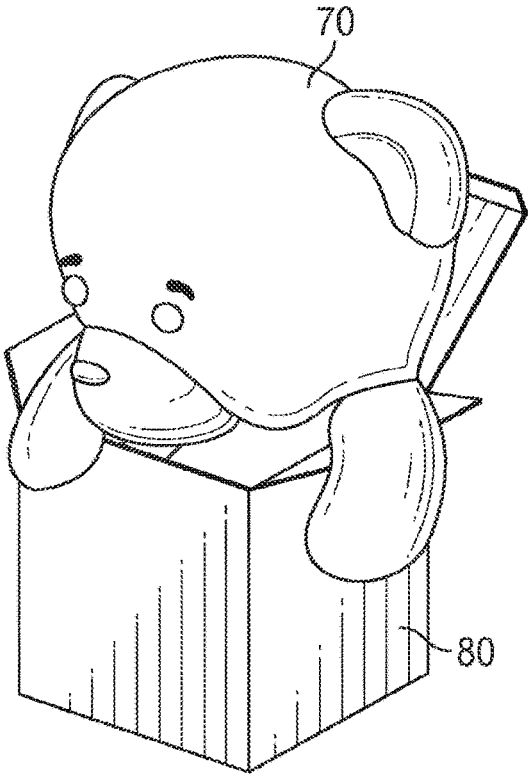
FIG. 3 is a perspective view of the invention, illustrating the plush toy expanding out of the package after the package is opened.
Figure 4:
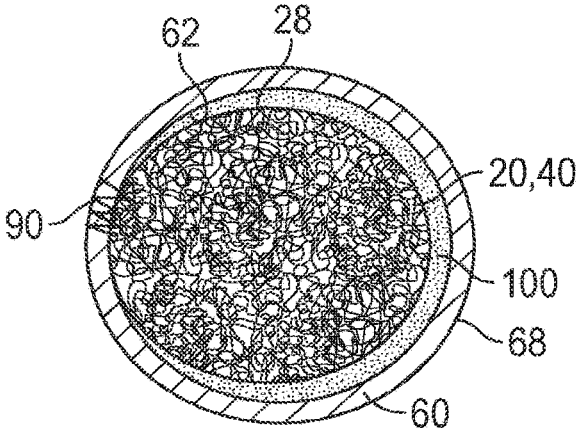
FIG. 4 is a cross-sectional view of the plush toy taken generally along line 4-4 of FIG. 1, illustrating a foam inner with an outer covering.
Figure 7:
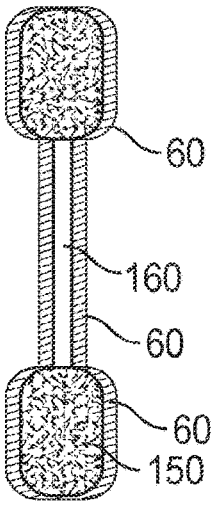
FIG. 7 is a cross-sectional view of an appendage of the plush toy having traditional fiberfill stuffing and/or no stuffing taken generally along line 7-7 of FIG. 1.
Figure 5A:
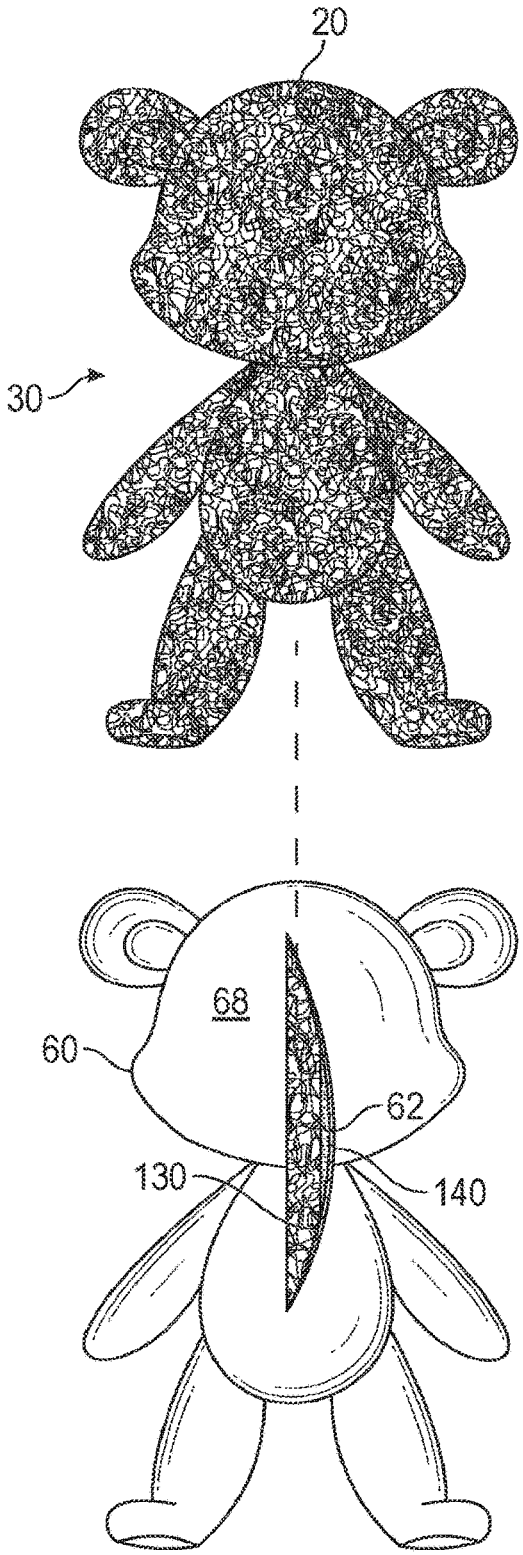
FIG. 5A is a front exploded elevational view of the foam inner, fully expanded to its natural size, and a flexible outer covering into which the foam inner is inserted.
Figure 5B:
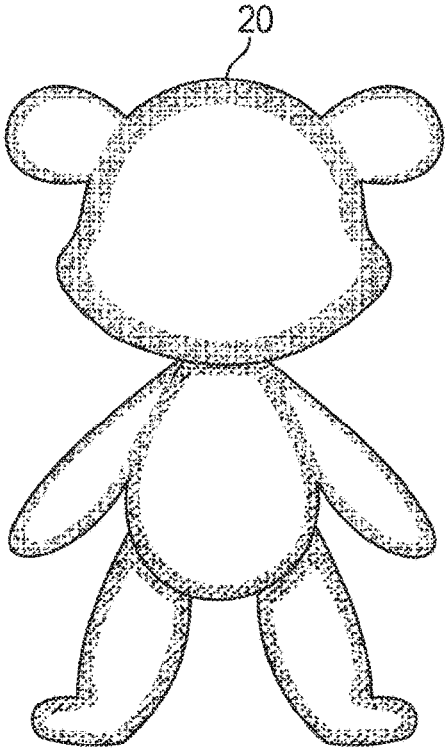
FIG. 5B is a cross-sectional view of a rear half of an alternate embodiment of the foam inner, illustrated with central hollow portions.
Figure 5C:
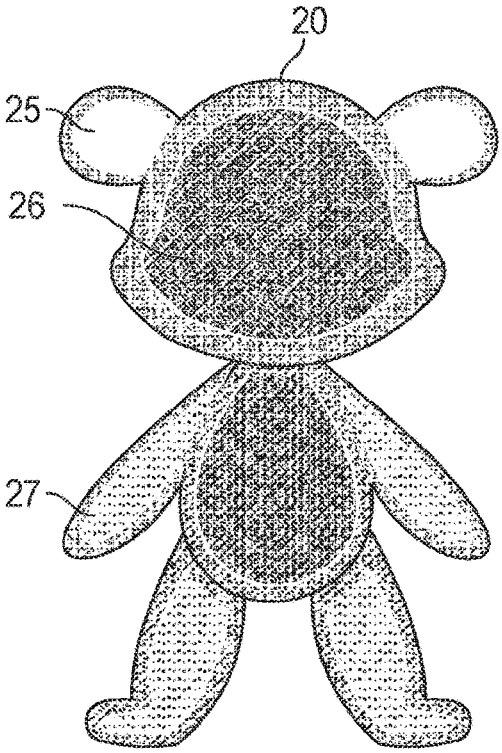
FIG. 5C is a cross-sectional view of a rear half of another alternate embodiment of the foam inner, illustrated with central hollow portions.
Figure 6A:
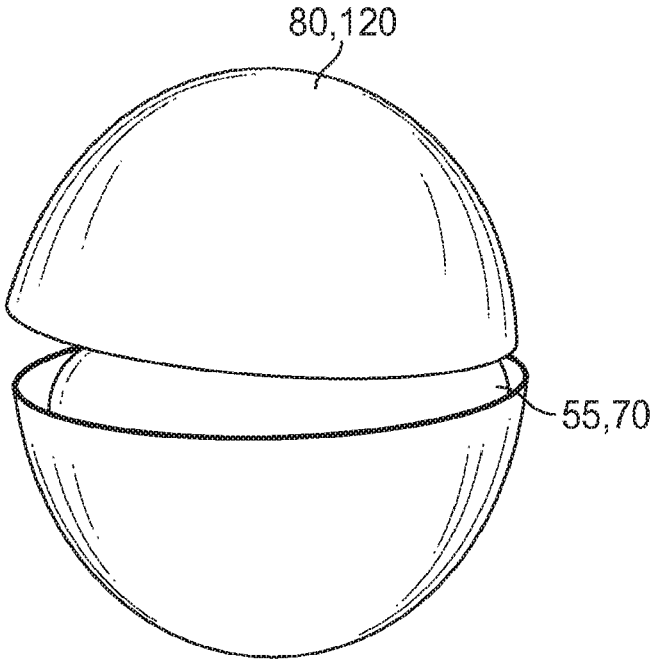
FIG. 6A is a perspective view of an alternate package of the invention, illustrated in a partially open position.
Figure 6B:
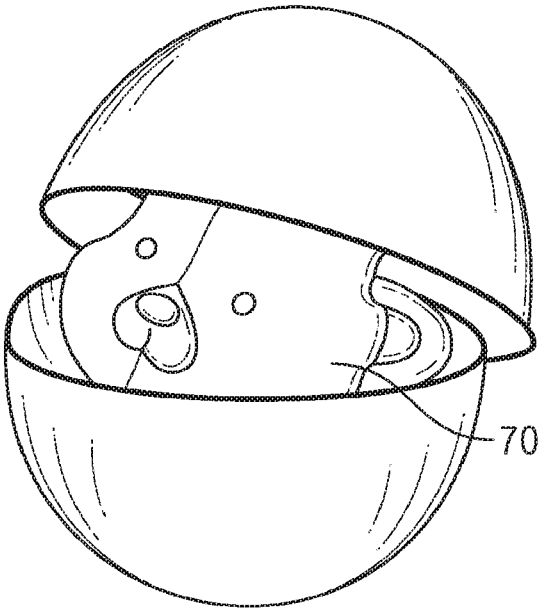
FIG. 6B is a perspective view of the embodiment of FIG. 6A, shown slightly more open and with the plush toy starting to expand towards its natural size.
Figure 6C:
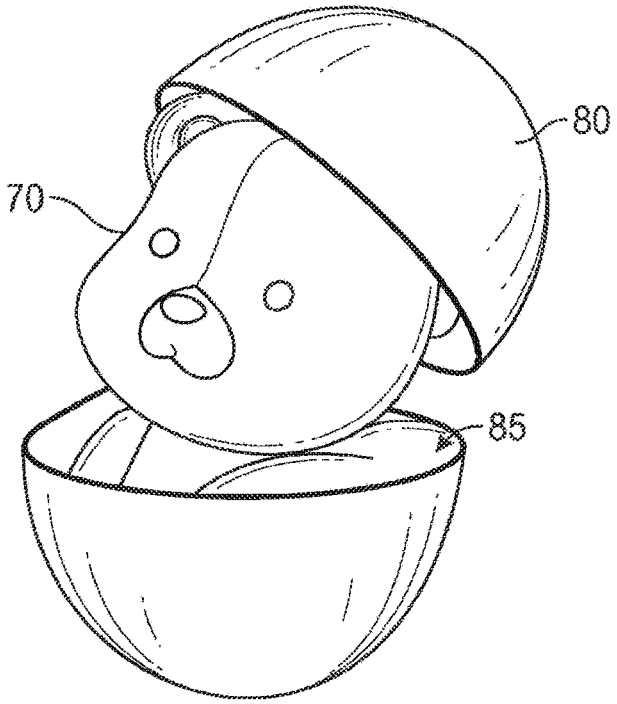
FIG. 6C is a perspective view of the embodiment of FIG. 6B, shown even more open and with the plush toy continuing to expand towards its natural size.
Figure 6D:
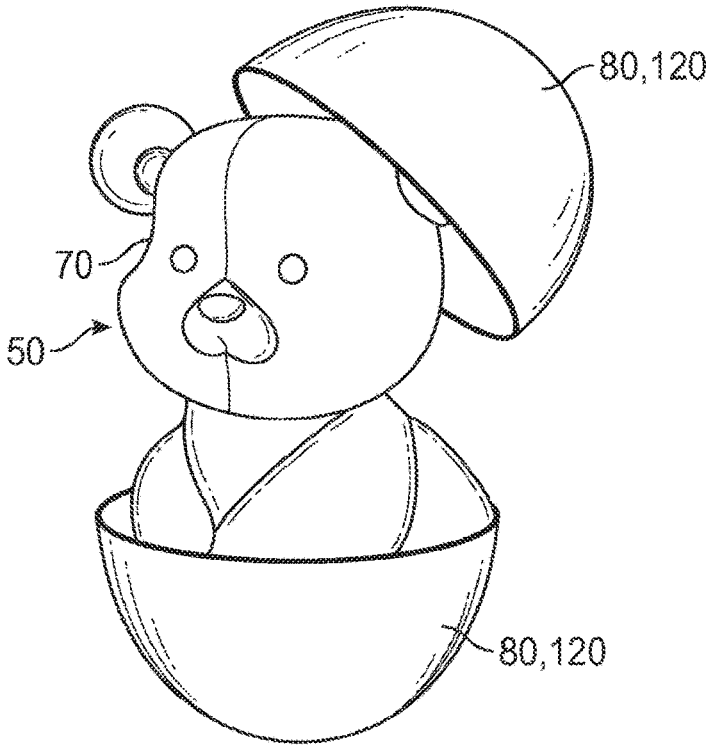
FIG. 6D is a perspective view of the embodiment of FIG. 6C, shown more fully open and with the plush toy continuing to expand towards its natural size.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

For purposes of the present disclosure the terms “a” and “an” herein do not denote a limitation of quantity, but rather denote the presence of at least one (1) of the referenced items. Further for purposes of the present disclosure the terms "in", "out", "left" "right", "up" or "down" are all spatial and functionally relative directions used to aid in the description to best explain the principles of the invention and its practical application, and to aid others skilled in the art to best utilize the invention and are not meant to be limiting to any particular orientation. It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

For purposes of the present disclosure the term "foam" is to be broadly construed. The term "foam" may include high, medium and/or low density latex based foam, either open or closed cell. The term "foam" may also include high, medium and/or low density polyurethane foam, either open or closed cell. The term "foam" may include high, medium and/or low density vinyl/nitrile (or "PVN") based foam, either open or closed cell. The term "foam" may include high, medium and/or low density polyvinyl chloride (or "PVC") based foam, either open or closed cell. The term "foam" may include high, medium and/or low density polyethylene terephthalate (or "PET") based foam, either open or closed cell. The term "foam" may further include a natural based foam, such as Mycoflex™ available from Ecovative Design LLC of Green Island, NY or other similar or equivalent mycelium based foam, either high, medium and/or low density foam, open or closed cell. Such natural based foams may be made biodegradable, natural, compostable and safe for children or pets. Additionally, while the use of "open cell" foams may not otherwise be strictly considered "memory" foam, such open cell foams may be utilized for embedding and/or to mix with other foam types.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words 'herein", "above", "below" and words of similar import, when used in this application, shall refer to this application as a whole and not to any particular portions of this application. When the claims use the word "or" in reference to a list of two or more items, that word covers all of the following interpretations of the word: any of the items in the list; all of the items in the list; and any combination of the items in the list. When the word "each" is used to refer to an element that was previously introduced as being at least one in number, the word "each" does not necessarily imply a plurality of the elements, but can also mean a singular element.

Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to FIG. 1 through FIG. 5B and FIG. 7, a plush toy system is illustrated comprising a foam inner 20 formed into a character shape 30, such as a doll, animal, or other character shape. The foam inner 20 comprises outer surface 28. The foam inner 20, when unconstrained, expands into a natural size 50. The foam inner 20 may comprise material that expands from a compressed state, preferably to a final size greater than its compressed size 55. Such a foam inner 20 may be made with an injection molding process, or by cutting and shaping a foam block into the character shape 30.

A flexible outer covering 60 surrounds the foam inner 20 and is sized in at least one dimension to be smaller than the natural size 50 of the foam inner 20. In some embodiments the outer covering 60 may be sized substantially the same as the natural size 50 of the foam inner 20 (FIG. 5A), but slightly smaller than the natural size of the foam inner 20. The outer cover 60 has an inner surface 62 for contacting the foam inner 20, and an outer surface 68. The foam inner 20 and the flexible outer covering 60 combine to form a plush toy 70. The covering 60 may include a flap 130 through which the foam inner 20 may be inserted during manufacturing of the plush toy 70. A closure 140, such as a zipper, hook-and-loop type fastener, mechanical snaps, or the like may be employed to close the flap 130 to seal the foam inner 20 inside the outer covering 60.

In preferred embodiments, at least a portion of the inner surface 62 of the outer covering 60 is fixed with the outer surface 28 of the foam inner 20 with stitching 90, adhesive 100 (FIG. 4), ultrasonic welding (not shown), or the like. Preferably the outer covering 60 is made with either a 2-way stretch material or 4-way stretch material, such as rayon or lycra, or other suitable web material such as woven or non-woven fabric, vinyl sheet material, or the like.

Figure 9:
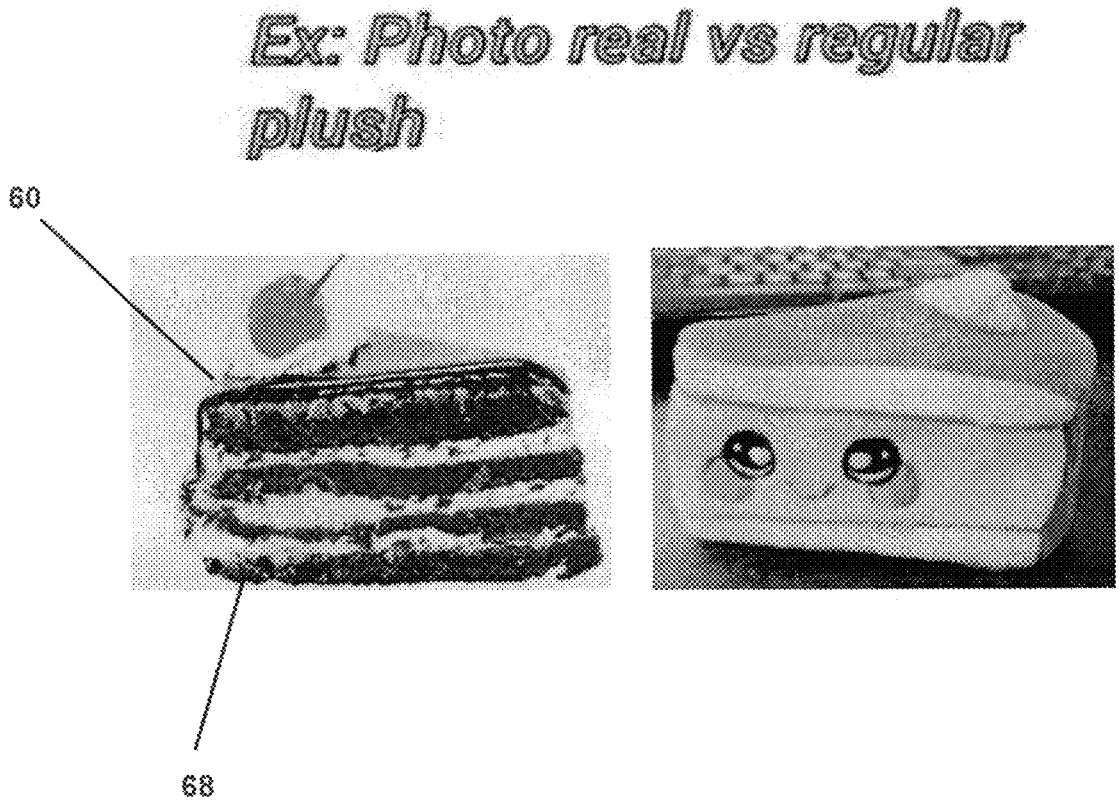
FIG. 9 is an example of a visual augmentation comparing the utilizing photoreal printing with conventional prior art.
Figure 14:
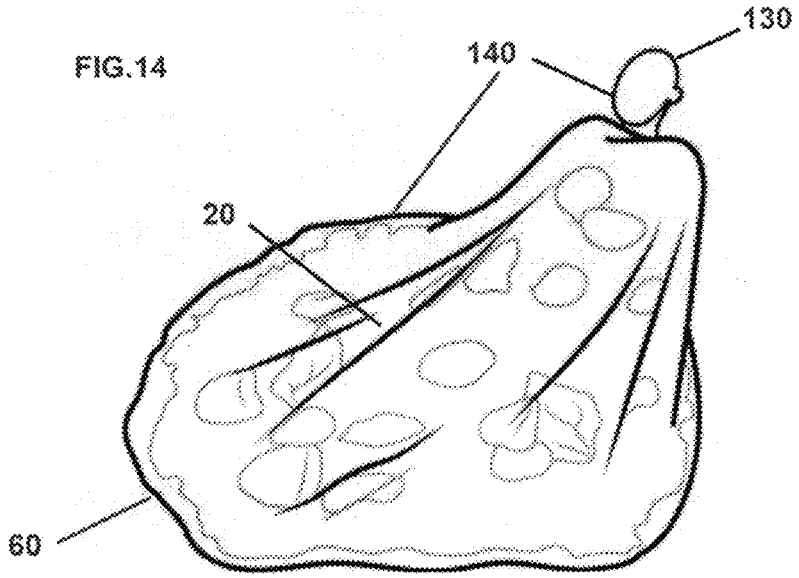
FIG. 14 is a photograph of a proof of concept prototype incorporation a photoreal printing according to a first alternate embodiment.
Figure 15:
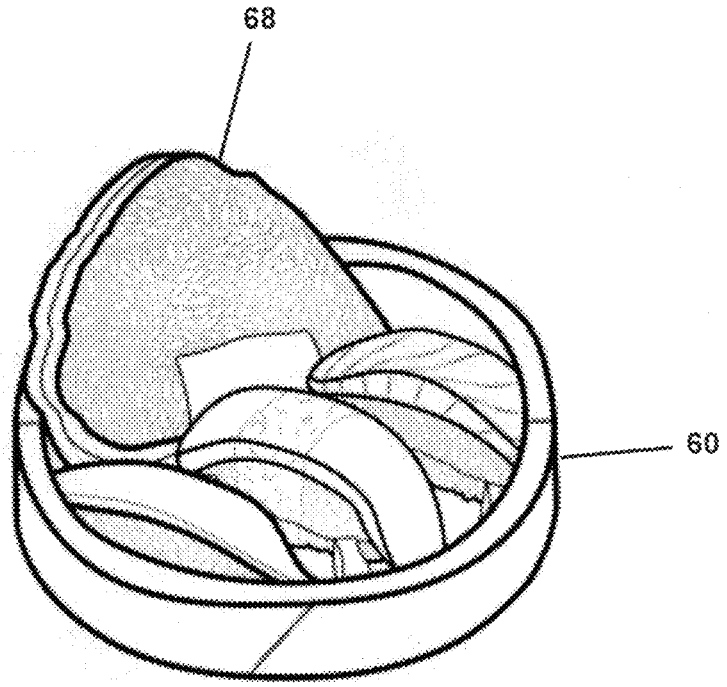
FIG. 15 is a rendering of a proof of concept prototype incorporation a photoreal printing according to a second alternate embodiment.
Figure 16:
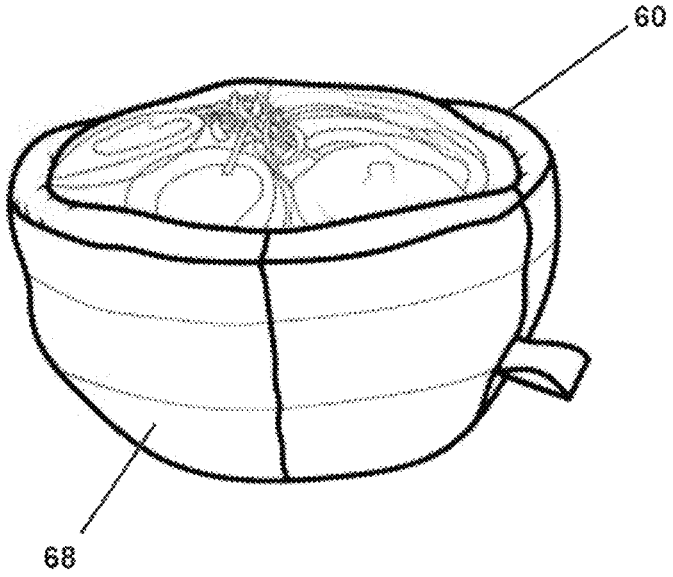
FIG. 16 is a rendering of a proof of concept prototype incorporation a photoreal printing according to a third alternate embodiment.
Figure 17:
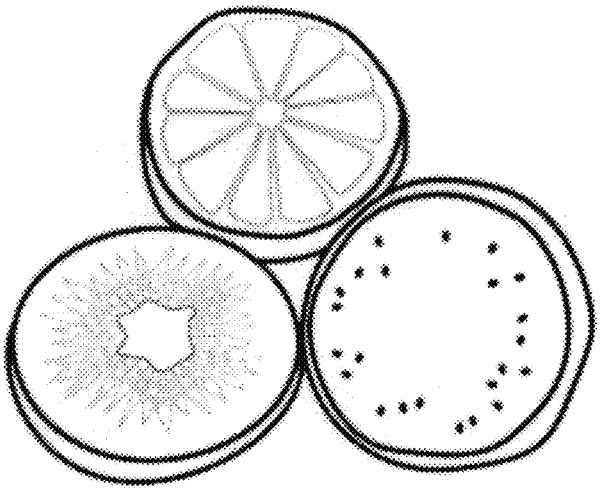
FIG. 17 is a photograph of a proof of concept prototype incorporation a photoreal printing according to a second alternate embodiment.

The outer covering 60 may further incorporate a visual augmentation, with the most preferred method being the incorporation of photoreal printing onto the outer surface 68. As shown in conjunction with FIG. 9, the use of photoreal printing may be used to decorate the outer surface 68 of the outer covering 60. Additional examples are also shown in FIG. 14 through FIG. 16 in alternate embodiments. Such printing may be done through "direct printing" techniques where inkjet inks are printed directly onto the textile with, for example, acid dye inks for printing on silk, polyamide and wool and reactive dye inks for printing on cellulose based textiles. Such a direct printing technique may further comprise the use of pre-treatments and post-treatments. A pre-treatment may, for example, consist of the application of a coasting to improve image quality. A post-treatment may, for example, be a washing and drying step to remove dyes that did not react with the fibers of the textiles and to improve wash fastness. As an alternate to direct printing, a "transfer printing" may also be used utilizing an inkjet ink containing sublimation dyes. This indirect printing technique is illustrated, for example, by U.S. Pat. No. 5,488,907 issued in the name of Sawgrass, which discloses the inkjet printing of an image on a temporary medium using an ink composition comprising heat activated ink solids, without activating the ink solids during the process of printing onto the medium. The image is transferred from the medium to the textile on which the image is to permanently appear by applying sufficient heat and pressure to the medium to activate and transfer the ink to the textile. In this approach the pre- and post-treatments are replaced by a heat transfer step. It would be desirable to be able to avoid this heat transfer step as this causes not only extra waste by the temporary medium but also waste by imperfect heat transfer and other type of errors. In addition, transfer printing only functions well on a limited number of synthetic textiles, such as polyester.

The system may also preferably includes a package 80 having at least one open side 85 through which the plush toy 70 traverses when compressed to fill an interior space 89 of the package 80. The package 80 may be a rectanguloid 110 (FIGS. 1-3), including a cube-shaped package 80. The package 80 may also take the form of a two-piece ovaloid 120 (FIGS. 6A-6D). wherein the at least one open side 85 is exposed when separating the two pieces thereof. Such an ovaloid 120 may include a sphere-shaped package 80. At least one package closure 88, such as a paper flap, may be included for selectively sealing the at least one open side 85. In such embodiments, the end consumer of the system may not know the character shape 30 of the plush toy 70 when opened, and as such an air of mystery is established with such a system. Alternately, the package 80 may take the form of a miniature version of the character shape 30 so as to provide an idea of the final shape of the plush toy 70 when its opened. Such a package 80 may be made of paper card stock, plastic, vinyl, glass, wood, acrylic, or the any other suitable material for a substantially rigid or resilient package 80.

As described in greater detail below, in use the plush toy 70 is compressed and contained within the package 80, and upon opening of the at least one open side 85 the plush toy 70 at least partially expands out of the at least one open side 85 of the package 80. When removed completely from the package 80 the plush toy 70 expands to the natural size 50 of the plush toy 70.

In some embodiments, the foam inner 20 includes one or more appendages 22 or other sections having within a stuffing 150 (FIG. 7) taken from the group consisting of: synthetic stuffing, natural stuffing, compressible foam, wool, polyester fiberfill, feathers, beads. Such appendages 22 are not necessarily as compressible as the rest of the foam inner 20, and as such should not be taken to imply that the terminology is being redefined herein to be restricted to any compressing such an appendage 22, or a different weight or rigidity than the foam inner 20. Alternately, appendages 22 or other hollow portions 25 could be made that include no fill 160 (FIGS. 5B, 5C and 7), such as an ear of a character that remains relatively flat. Alternately appendages 22 could be made with foam material 40 having different expansion rates, or a mix of foam material 40 to get differing effects upon release of the plush toy 70 from its compressed size 55.

For example, in some embodiments, the foam inner 20 is comprised of at least two type of compressible foam material 40 that have different natural expansion rates, such that portions 26 (FIG. 5C) of the foam inner 20 with a quicker expansion rate reach their natural size 50 more quickly than other portions 27 with a foam material 40 having a slower expansion rate. As such, based on the size of the various appendages 22 and foam material 40 used therewith, the foam inner 20 may be designed such that all portions of the character shape 30 achieve their natural size 50 at roughly the same time when released from their compressed size 55. For example, the body portion 26 of the character shape 30 may include a more quickly-expanding foam material 40 than arm or leg portions 27.

By way of example, and not as a limitation, the compressible foam material 40 may include a viscoelastic, temperature sensitive foam. Such a "memory" foam is currently used otherwise for in mattress applications in the existing art. Such a foam material 40 may be provided having the physical property described in Table 1 below.

TABLE 1

| Quality | Property |
|---|---|
| Nominal Piece Density Range | 48-52 kg/m3 |
| Nominal Hardness (40%) Strength | 70-100N |
| Nominal Tensile Strength | 50 kPa min. |
| Nominal Elongation at Break | 180%. |
| Resilience | 16% max. |
| Recovery rate | 5-20 secs. |
| Compression set (50%) | 12% max. |

Figure 8:
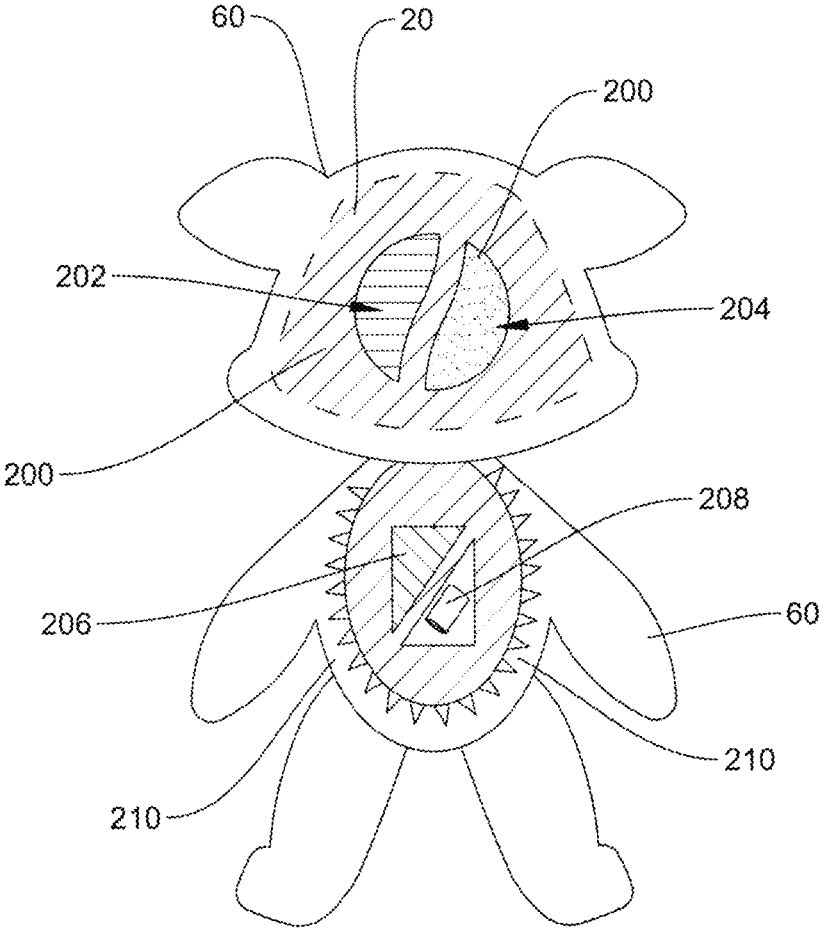
FIG. 8 is a cross-sectional view of a rear half of yet another alternate embodiment of the foam inner, illustrated with variations of additional functional augmentation.

In various embodiments the foam inner may further incorporate a number of additional features to augment the functionality of the foam. By way of example, and not as a limitation, FIG. 8 depicts an exemplary embodiment of the present invention demonstrating several variations of a functional augmentation 200. The foam inner 20 may include a filled bladder 201 including a liquid 202 or non-Newtonian fluid 204. The liquid 202 may include a soap, chemical liquid or other liquid of differing or varying viscosity. By way of example, the inclusion of a molding compound or "play slime" type of malleable play material. The foam inner 20 may further include a secondary foam element 206 of a difference density, consistency or other physical property than that of the main foam inner 20. The foam inner 20 may further include a tactile toy or other tactile physical device 208 retained within the foam inner 20. The tactile physical device 208 may comprise a motorized device or audible/tactile electronics embedded within the foam inner 20. In any of these aspects the inclusion of a tactile response component is contained within the foam inner 20, thereby augmenting the foam structure as well as modifying the interaction of such an embedded item by itself (i.e., without embedding within the foam). By creating variations in the foam inner 20, a mixture of different foams having different properties to give different textures, or create a movement of effect or the like.

Finally, the foam inner 20 may further incorporate a texture 210 onto the foam inner 20 itself in the form of ridges, bumps, grooves, or any other shape that imparts a texture feel through the outer covering 60 and to the outside of the plush toy.

2. Operation of the Preferred Embodiment

In operation, the present invention compressed and contained within the package, upon opening of the at least one open side the plush toy at least partially expands out of the at least one open side of the package. When removed completely from the package the plush toy expands to the natural size of the plush toy. With the plush toy compressed below it normal size, or size and shape, the toy is allowed to expand to its natural size when deployed.

After deployed, the incorporation of any additional functions or features provide and additional sensory input during play. The embossing the foam itself with a texture may impart a differential feel through the outer cover and to the outside of the plush toy, or the incorporation of a foam inner of a mixture of different foams having different properties to give different textures, or create a movement of effect or the like can further provide such sensory impressions.

When used in a version that incorporates a package, the foam inner plush toy is stored in a compressed size less that of its natural, expanded size when unconstrained by the package. When unboxed or unwrapped, and additional effect is provided as the foam self-reinflates with air when the package is opened.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A plush toy comprising:

a foam inner formed of a compressible foam material having an outer surface, the foam inner having a natural size when unconstrained; and a functional augmentation encapsulated or embedded at least in part by the foam inner;

a shape defining textile fabric outer covering entirely surrounding the foam inner, wherein the foam inner is compressed and constrained by the textile fabric outer covering such that the foam inner does not achieve a natural, uncompressed size or shape.

2. The plush toy of claim 1, wherein the functional augmentation is selected from a group consisting of: a liquid contained within a filled bladder; a second foam inner of a different density; beads; a play slime contained within a filled bladder; a non-Newtonian fluid; a non-Newtonian fluid contained within a filled bladder; a tactile physical device; a motorized device; an audible electronics; and a tactile electronics.

3. The plush toy of claim 2, further comprising:

a visual augmentation applied to or incorporated onto an outer surface of said textile fabric outer covering.

4. The plush toy of claim 3, wherein said visual augmentation comprises a photoreal printed image.

5. The plush toy of claim 2, wherein said foam inner further comprises a texture onto an outer surface of the foam inner, said texture imparting a tactile feel through said textile fabric outer covering.

6. The plush toy of claim 2, wherein said foam inner is a high density, medium density or lower density foam formed of a material selected from a group consisting of: viscoelastic foam; polyurethane foam; vinyl/nitrile or PVN based foam; polyvinyl chloride or PVC based foam; polyethylene terephthalate or PET based foam; and a mycelium based foam.

7. The plush toy of claim 6, wherein said foam inner further comprises an open cell foam or a closed cell foam.

8. The plush toy of claim 7, wherein said foam inner is biodegradable or compostable.

9. The plush toy of claim 1, further comprising:

a visual augmentation applied to or incorporated onto an outer surface of said textile fabric outer covering.

10. The plush toy of claim 9, wherein said visual augmentation comprises a photoreal printed image.

11. The plush toy of claim 1, wherein said foam inner further comprises a texture onto an outer surface of the foam inner, said texture imparting a tactile feel through said textile fabric outer covering.

12. The plush toy of claim 1, wherein said foam inner is a high density, medium density or lower density foam formed of a material selected from a group consisting of: viscoelastic foam; polyurethane foam; vinyl/nitrile or PVN based foam; polyvinyl chloride or PVC based foam; polyethylene terephthalate or PET based foam; and a mycelium based foam.

13. The plush toy of claim 12, wherein said foam inner further comprises an open cell foam or a closed cell foam.

14. The plush toy of claim 12, wherein said foam inner is biodegradable or compostable.

* * * * *